US007254969B2

(12) United States Patent
Hawkins et al.

(10) Patent No.: US 7,254,969 B2
(45) Date of Patent: Aug. 14, 2007

(54) RIBBED WASHING MACHINE BASKET

(75) Inventors: Larry Hawkins, Louisville, KY (US); Derek Lee Watkins, Elizabethtown, KY (US); Ronald Miles Johnson, Jeffersontown, KY (US)

(73) Assignee: General Electric Company, Schenectady, NY (US)

( * ) Notice: Subject to any disclaimer, the term of this patent is extended or adjusted under 35 U.S.C. 154(b) by 570 days.

(21) Appl. No.: 10/064,922

(22) Filed: Aug. 29, 2002

(65) Prior Publication Data

US 2004/0040346 A1 Mar. 4, 2004

(51) Int. Cl.
*D06F 37/26* (2006.01)

(52) U.S. Cl. ..... 68/133; 68/131

(58) Field of Classification Search ..... 68/142, 68/133, 131, 24

See application file for complete search history.

(56) References Cited

U.S. PATENT DOCUMENTS

| | | | | | |
|---|---|---|---|---|---|
| 913,506 | A | * | 2/1909 | Josselyn | 68/142 |
| 1,596,440 | A | * | 8/1926 | McDonald et al. | 68/25 |
| 1,657,963 | A | * | 1/1928 | Gorn | 68/25 |
| 1,701,187 | A | * | 2/1929 | Maus | 68/174 |
| 1,747,620 | A | * | 2/1930 | Clarke | 68/10 |
| 1,772,207 | A | * | 8/1930 | Clarke | 68/10 |
| 2,039,249 | A | * | 4/1936 | Iskyan et al. | 68/140 |
| 2,056,888 | A | * | 10/1936 | Pecker | 210/145 |
| 2,065,263 | A | * | 12/1936 | Beldam | 210/397 |
| 2,138,858 | A | * | 12/1938 | Hjelm | 68/25 |
| 2,149,252 | A | * | 3/1939 | Cleveland | 210/781 |
| 2,192,758 | A | * | 3/1940 | Skinner | 68/28 |
| 2,274,809 | A | * | 3/1942 | Robinson | 99/634 |
| 2,296,267 | A | * | 9/1942 | Baird | 68/24 |
| 2,369,905 | A | * | 2/1945 | Page | 74/81 |
| 2,578,468 | A | * | 12/1951 | Fleischer | 210/374 |
| 2,637,186 | A | * | 5/1953 | Douglas | 68/23.4 |
| 2,734,368 | A | * | 2/1956 | Richardson | 68/142 |
| 2,737,040 | A | * | 3/1956 | Anderson | 68/23.3 |
| 3,277,583 | A | * | 10/1966 | Mack | 34/58 |
| 3,603,118 | A | * | 9/1971 | Brucken et al. | 68/23 R |
| 3,729,834 | A | * | 5/1973 | Fox | 34/139 |
| 4,202,187 | A | | 5/1980 | Hukuzawa et al. | |
| 4,233,827 | A | * | 11/1980 | Stokes | 68/172 |
| 4,328,600 | A | * | 5/1982 | Bochan | 8/159 |
| 4,329,859 | A | * | 5/1982 | Roberts | 68/23 R |
| 4,464,914 | A | * | 8/1984 | Torita | 68/23.5 |
| 4,495,784 | A | * | 1/1985 | Ikeda | 68/23.6 |

(Continued)

FOREIGN PATENT DOCUMENTS

DE 1 958 076 * 5/1971

(Continued)

OTHER PUBLICATIONS

European Patent Office 0 572 983 Jun. 1993.*

*Primary Examiner*—Frankie L. Stinson
(74) *Attorney, Agent, or Firm*—George L. Rideout, Esq.; Armstrong Teasdale LLP

(57) ABSTRACT

A basket for a washing machine includes a body comprising an outer wall and at least one rib extending radially inward from said wall, said rib comprising at least a first portion having a first cross section and a second portion having a second cross section, said second cross section different from said first cross section.

18 Claims, 9 Drawing Sheets

U.S. PATENT DOCUMENTS

| | | | | | |
|---|---|---|---|---|---|
| 4,711,104 | A | * | 12/1987 | Ikeda | 68/23 R |
| 4,835,993 | A | * | 6/1989 | Dreher | 68/142 |
| 4,848,105 | A | * | 7/1989 | O'Connell et al. | 68/18 F |
| 4,920,661 | A | * | 5/1990 | Fukuzawa et al. | 34/58 |
| 4,922,939 | A | * | 5/1990 | Adamczyk | 134/140 |
| 5,231,857 | A | * | 8/1993 | Rew et al. | 68/134 |
| 5,378,364 | A | * | 1/1995 | Welling | 210/512.1 |

FOREIGN PATENT DOCUMENTS

| | | | |
|---|---|---|---|
| DE | 2 225 780 | * | 12/1972 |
| DE | 2 310 435 | * | 12/1974 |
| DE | 33 17 201 | * | 11/1984 |
| DE | 37 28 361 | * | 3/1989 |
| JP | 54-102663 | * | 8/1979 |
| JP | 54-120958 | * | 9/1979 |
| JP | 60-63089 | * | 4/1985 |
| JP | 3-103300 | * | 4/1991 |
| JP | 5-15683 | * | 1/1993 |
| JP | 5-123486 | * | 5/1993 |
| JP | 7-68085 | * | 3/1995 |
| JP | 7-68087 | * | 3/1995 |
| JP | 10-71300 | * | 3/1998 |
| JP | 11-76679 | * | 3/1999 |

* cited by examiner

RIBBED WASHING MACHINE BASKET

BACKGROUND OF THE INVENTION

This invention relates generally to washing machines, and, more particularly, to baskets for washing machines.

Washing machines typically include a cabinet that houses an outer tub for containing wash and rinse water, a perforated clothes basket within the tub, and an agitator within the basket. A drive and motor assembly is mounted underneath the stationary outer tub to rotate the clothes basket and the agitator relative to one another, and a pump assembly pumps water from the tub to a drain to execute a wash cycle. Conventionally, the basket is spun at appropriate times in the wash cycle to extract water and wash fluids from clothes.

In an effort to improve water extraction from the basket and to improve water penetration through clothes, at least one known basket includes a plurality of protrusions formed on an inner peripheral wall of the basket and extending in a vertical direction. The protrusions have an arcuate cross section forming a ridge projecting toward the center of the basket, and a plurality of grooves are formed in the basket sidewall in between adjacent protrusions. The grooves include a plurality of hydroextracting apertures therein. Such a basket is intended to reduce a force that radially outer clothes are pressed against the peripheral wall of the basket. See, for example, U.S. Pat. No. 4,202,187.

While the protrusions in such a basket are of some benefit in reducing cycle wash times by improving water extraction from clothes, the protrusions can be problematic from a manufacturing perspective. Aside from complicating mold designs from producing the baskets, the protrusions can create undesirable stress distributions in the basket as the basket is spun, and the stress distributions can be compounded by heavy wash loads and unbalanced loads in the basket. Overstressing the basket can lead to impaired washing performance and reduced longevity of the basket, while an overly reinforced basket results in added material costs and inefficient manufacturing operations.

SUMMARY OF THE INVENTION

In one aspect, a basket for a washing machine is provided. The basket comprises a body comprising an outer wall and at least one rib extending radially inward from said wall, said rib comprising at least a first portion having a first cross section and a second portion having a second cross section, said second cross section different from said first cross section.

In another aspect, a washing machine basket is provided. The basket comprises an outer wall, and a plurality of ribs projecting radially inwardly from said outer wall. Each said rib comprises a first end and a second end, said first end projecting a first radial distance from said outer wall, said second end projecting a second radial distance from said outer wall. The first radial distance is less than the second radial distance.

In another aspect, a washing machine basket comprising an outer wall and a plurality of vertically extending ribs projecting radially inwardly from said outer wall at a distance of about 0.395 to about 1.5 inches is provided.

In another aspect, a washing machine basket is provided. The basket comprises a substantially cylindrical outer wall and a plurality of inwardly projecting ribs depending therefrom. Each said rib comprises a first portion having a first radially extending height from said outer wall and a first tangential width and a second portion having a second radially extending height from said outer wall and a second tangential width. The first height is less than said second height, and the first width is greater than the second width.

In yet another aspect, a washing machine is provided. The machine comprises a cabinet and a basket rotatably mounted in said cabinet. The basket comprises an outer wall and a plurality of radially inwardly projecting ribs extending from said outer wall. The ribs have a varying width between ends thereof.

DETAILED DESCRIPTION

Figure 1:
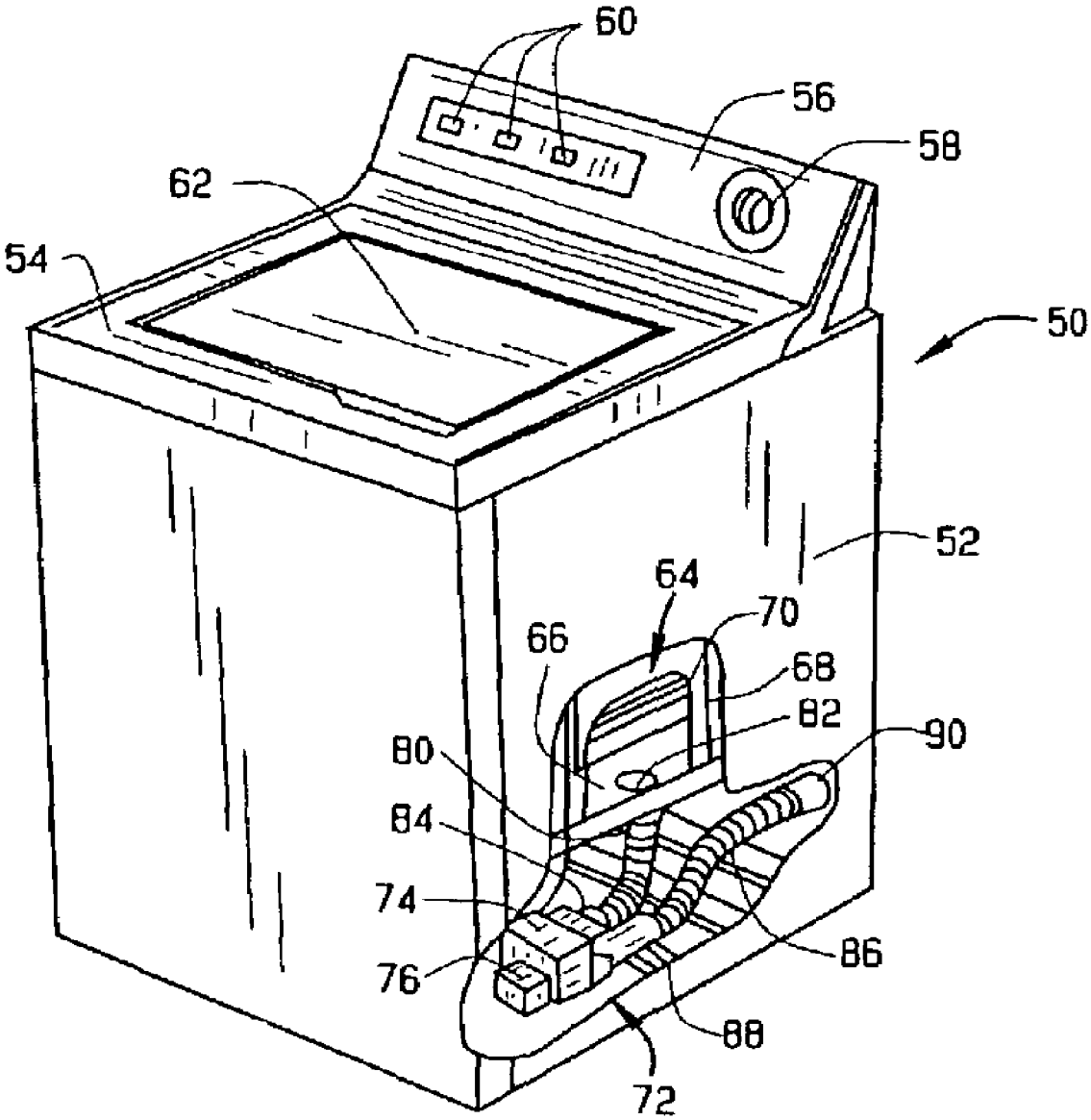
FIG. 1 is a perspective cutaway view of an exemplary washing machine.

FIG. 1 is a perspective view partially broken away of an exemplary washing machine 50 in which the present invention may be practiced. It is recognized, however, that the benefits of the present invention may be demonstrated in other types of machines, and in various models of washing machines. The description of washing machine 50 herein is therefore offered for illustrative purposes only, and is in no way intended to limit application of the invention in any aspect.

Washing machine 50 includes a cabinet 52 and a cover 54. A backsplash 56 extends from cover 54, and a timer mechanism 58 and variety of appliance control input selectors 60 are coupled to backsplash 56. Timer mechanism 58 and input selectors 60 collectively form a user interface input for operator selection of machine cycles and features. A lid 62 is mounted to cover 54 and is rotatable about a hinge (not shown) between an open position (not shown) facilitating access to a wash tub 64 located within cabinet 52, and a closed position (shown in FIG. 1) forming a covered enclosure over wash tub 64.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74, a motor 76, and in an exemplary embodiment a motor fan (not shown). A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
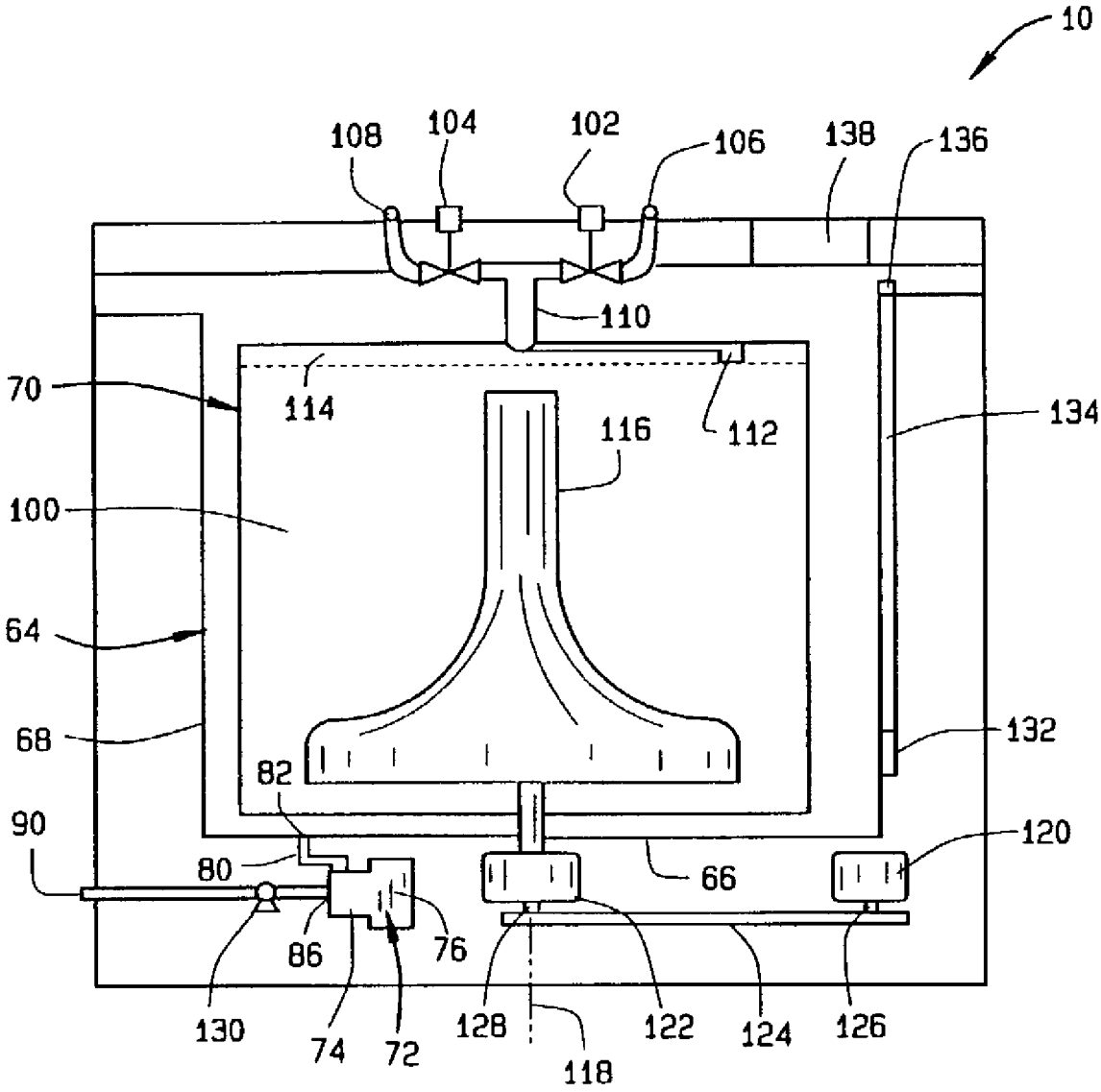
FIG. 2 is front elevational schematic view of the washing machine shown in FIG. 1.

FIG. 2 is a front elevational schematic view of washing machine 50 including wash basket 70 movably disposed and rotatably mounted in wash tub 64 in a spaced apart relationship from tub side wall 64 and tub bottom 66. Basket 70 includes a plurality of perforations therein to facilitate fluid communication between an interior 100 of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a fresh water supply for use in washing machine 50. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing or articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitator, impeller, or oscillatory basket mechanism 116 is disposed in basket 70 to impart an oscillatory motion to articles and liquid in basket 70. As illustrated in FIG. 2, agitator 116 is oriented to rotate about a vertical axis 118. It is contemplated, however, that at least some of the benefits of the present invention may apply to horizontal axis washing machines as well.

In an exemplary embodiment, basket 70 and agitator 116 are driven by motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitator 116 for rotatable movement within wash tub 64, and clutch system 122 facilitates relative rotation of basket 70 and agitator 116 for selected portions of wash cycles Motor 120, transmission and clutch system 122 and belt 124 collectively are referred herein as a machine drive system. As will be appreciated below, the motor drive system is a multiple speed drive in that it is capable of spinning basket 70 at multiple speeds to accomplish different objectives at different points in the wash cycle.

Washing machine 50 also includes a brake assembly (not shown) selectively applied or released for respectively maintaining basket 70 in a stationary position within tub 64 or for allowing basket 70 to spin within tub 64. Pump assembly 72 is selectively activated to remove liquid from basket 70 and tub 64 through drain outlet 90 and a drain valve 130 during appropriate points in washing cycles as machine 50 is used.

In an exemplary embodiment, machine 50 also includes a reservoir 132, a tube 134 and a pressure sensor 136. As fluid levels rise in wash tub 64, air is trapped in reservoir 132 creating a pressure in tube 134 that pressure sensor 136 monitors. Liquid levels, and more specifically, changes in liquid levels in wash tub 64 may therefore be sensed, for example, to indicate laundry loads and to facilitate associated control decisions. In further and alternative embodiments, load size and cycle effectiveness may be determined or evaluated using other known indicia, such as motor spin, torque, load weight, motor current, voltage or current phase shifts, etc.

Operation of machine 50 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 50 to execute selected machine cycles and features.

In an illustrative embodiment, clothes are loaded into basket 70, and washing operation is initiated through operator manipulation of control input selectors 60 (shown in FIG. 1) and timer mechanism 58 (shown in FIG. 1). Tub 64 is filled with water and mixed with detergent to form a wash fluid, and basket 70 is agitated with agitator 116 for cleansing of clothes in basket 70. After a predetermined period of agitation, tub 64 is drained with pump assembly 72, and basket 70 is spun to extract wash fluid from the clothes. Clothes are then rinsed with fresh water and basket 70 is spun again to remove water from clothes. Depending on the particular wash cycle selected, multiple wash and spin portions of the wash cycle may be executed.

Figure 3:
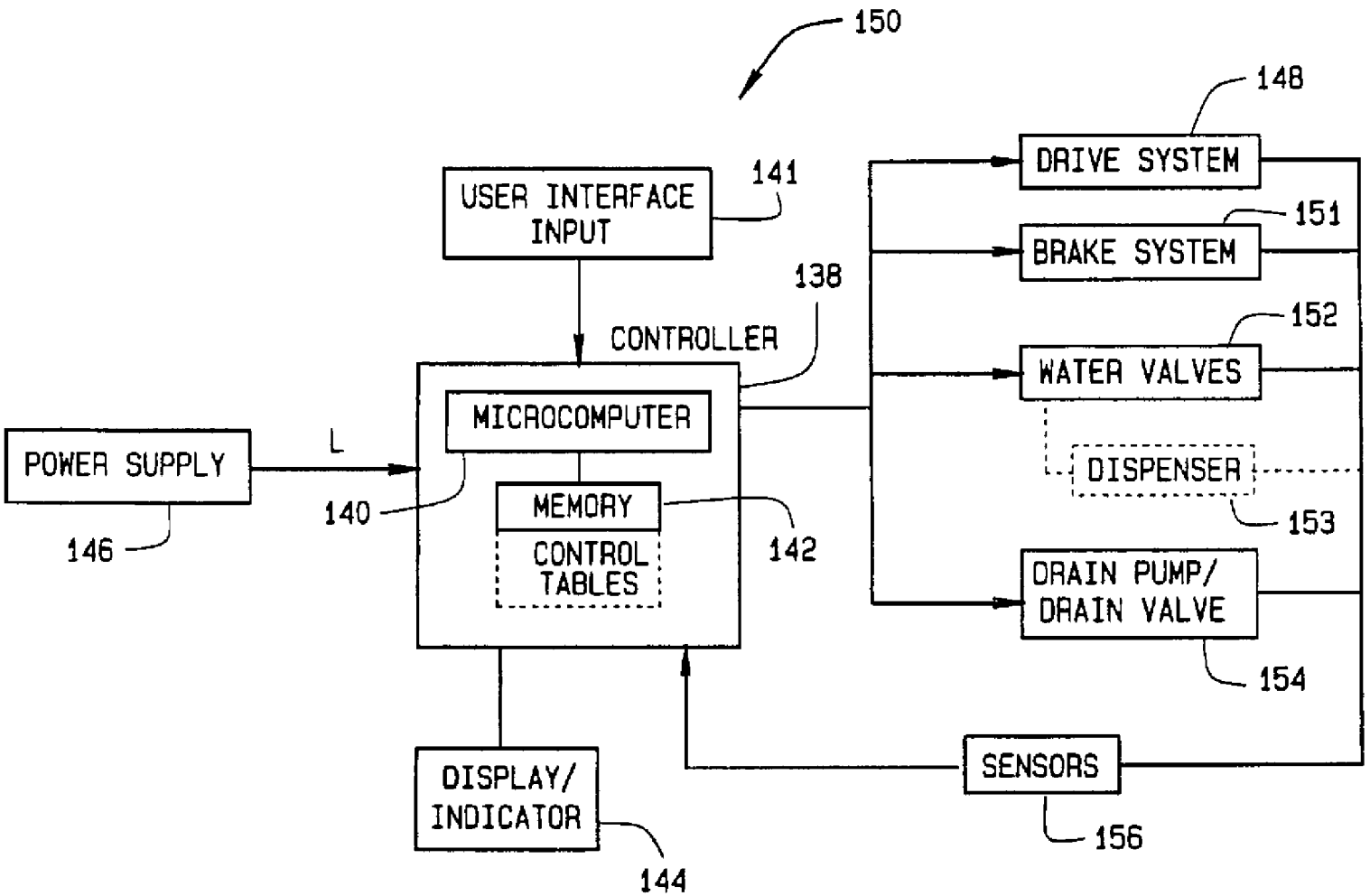
FIG. 3 is a schematic block diagram of a control system for the washing machine shown in FIGS. 1 and 2.

FIG. 3 is a schematic block diagram of an exemplary washing machine control system 150 for use with washing machine 50 (shown in FIGS. 1 and 2). Control system 150 includes controller 138 which may, for example, be a microcomputer 140 coupled to a user interface input 141. An operator may enter instructions or select desired washing machine cycles and features via user interface input 141, such as through input selectors 60 (shown in FIG. 1) and a display or indicator 144 coupled to microcomputer 140 displays appropriate messages and/or indicators, such as a timer, and other known items of interest to washing machine users. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to electronically erasable programmable read only memory (EEPROM).

Power to control system 150 is supplied to controller 138 by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively couple to machine drive system 148 (e.g., motor 120 and clutch system 122 shown in FIG. 2), a brake assembly 151 associated with basket 70 (shown in FIGS. 1 and 2), machine water valves 152 (e.g., valves 102, 104 shown in FIG. 2) and machine drain system 154 (e.g., drain pump assembly 72 and/or drain valve 130 shown in FIG. 2) according to known methods. In a further embodiment, water valves 152 are in flow communication with a dispenser 153 (shown in phantom in FIG. 3) so that water may be mixed with detergent or other composition of benefit to washing of garments in wash basket 70 (shown in FIG. 1).

In response to manipulation of user interface input 141 controller 138 monitors various operational factors of washing machine 50 with one or more sensors or transducers 156, and controller 138 executes operator selected functions and features according to known methods.

While an electronic controller 138 is described and illustrated in FIG. 3, it is contemplated that known electromechanical control mechanisms may be employed in alternative embodiments.

Figure 4:
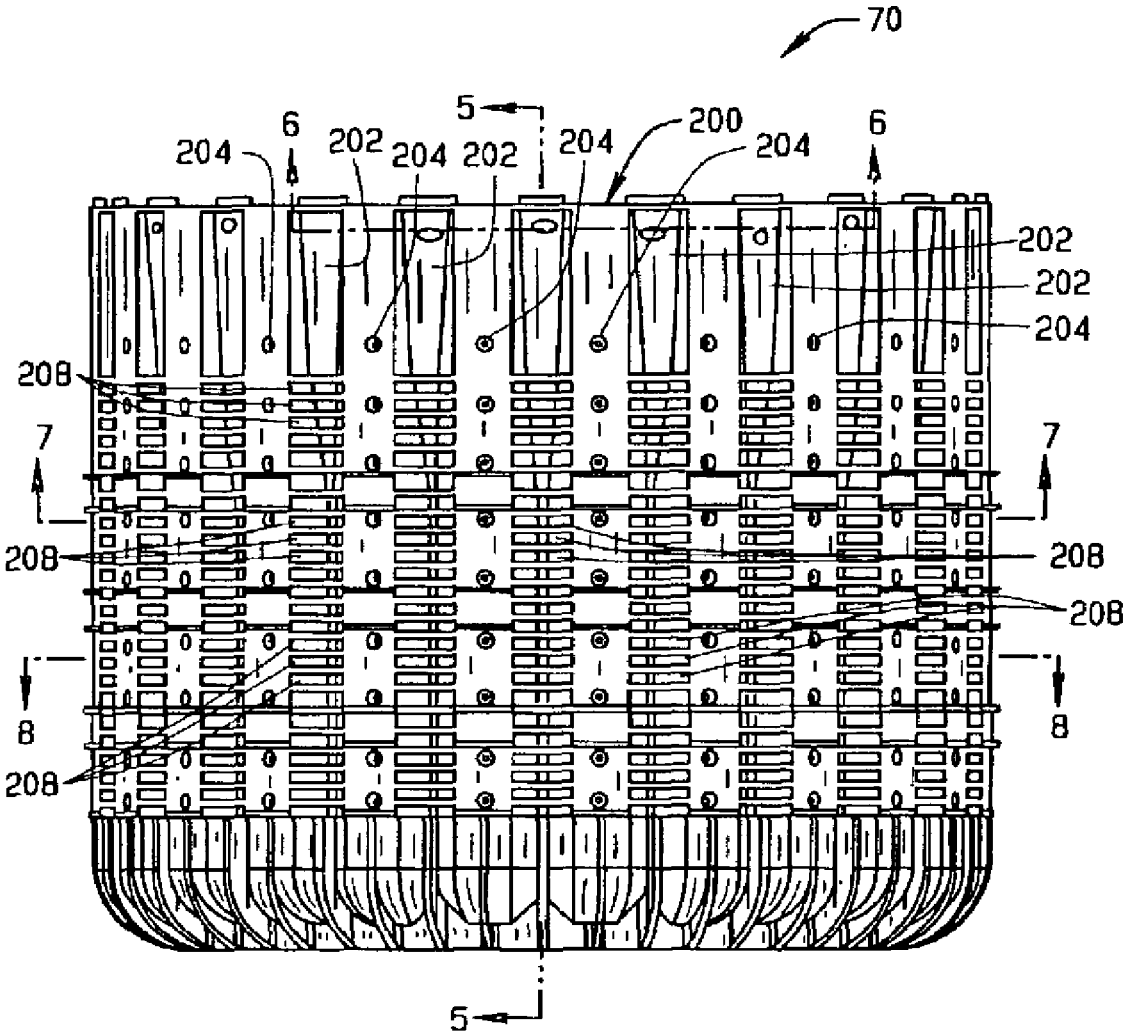
FIG. 4 is an elevational view of a basket for the machine shown in FIGS. 1 and 2.

FIG. 4 is an elevational view of washing machine basket 70 in an exemplary embodiment of the present invention. Basket 70 includes a body having an outer peripheral wall 200 that is generally cylindrical in shape, has a substantially constant draft in diameter (e.g., about a 1.5° draft in one embodiment), and extends circumferentially about an outer periphery of basket 70. Outer peripheral wall 200 includes a plurality of apertures 204 therethrough for passage of water and wash fluid through basket wall 200, and a number of ribs 202 depend inwardly from outer peripheral wall 200 toward a center, or toward the interior, of basket 70. Thus, when viewed from die basket exterior, as illustrated in FIG. 4, ribs 202 are depressed or recessed relative to outer peripheral wall 200.

As explained in detail below, ribs 202 extend substantially vertically in an exemplary embodiment on an interior of basket 70 and each rib 202 includes a face and opposite sides extending from the face. A plurality of circumferential supports 208 extend outwardly ribs 202 and are substantially flush with and connected to basket outer peripheral wall 200. Supports 208 add strength and rigidity to basket 70 and help to distribute stress in basket 70 during use. Ribs 202 are shaped to increase water extraction rates from clothes placed in basket 70 while controlling stresses generated in basket 70 during use. Thus, manufacturing resources for basket 70 can be substantially optimized to lower costs while offering performance advantages superior to known washing machine baskets.

Figure 5:
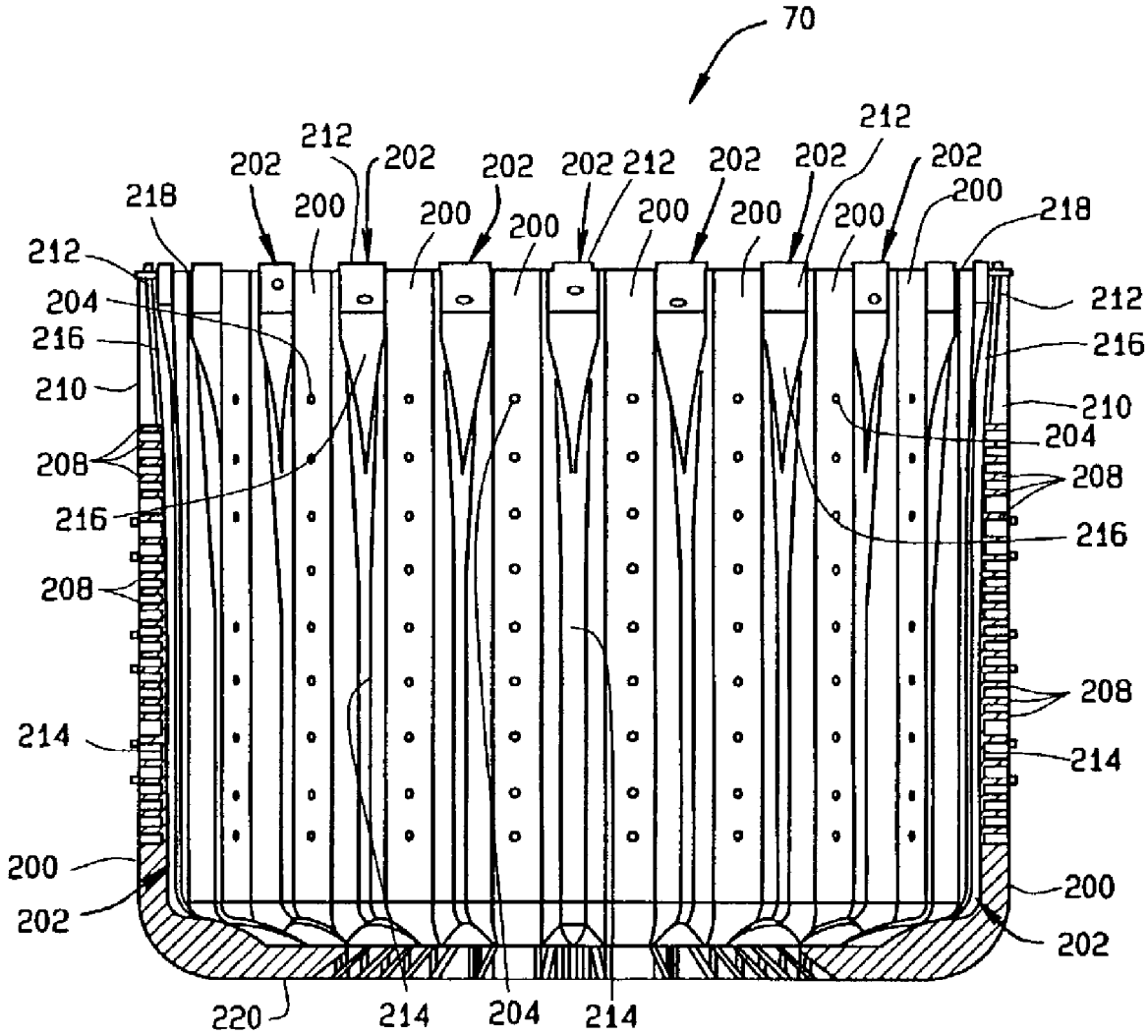
FIG. 5 is a vertical cross sectional view of the basket along line 5-5 in FIG. 4.

Referring now to FIG. 5, basket 70 is illustrated in vertical cross section. Ribs 202 project inwardly from basket outer peripheral wall 200 such that the face of each rib 202 is spaced radially inwardly from an outer surface 210 of basket outer peripheral wall 200. Apertures 204 extend through outer peripheral wall 200 and are generally vertically aligned in columns between ribs 202. Supports 208 extend radially outwardly from behind ribs 202 to a substantially flush position with respect to basket outer wall surface 210.

Each rib 202 includes distinct segments extending from one another on an interior of basket 70 to provide ribs 202 with a non-uniform cross-section from top to bottom as explained in more detail below. In an exemplary embodiment, each rib 202 includes an upper portion 212 extending radially inwardly a first and substantially constant radial distance from basket outer surface 210, a lower portion 214 extending radially inwardly a second and substantially constant radial distance from basket outer surface 210, and an intermediate portion 216 extending between rib upper and lower portions 212, 214 and extending a variable inward radial distance from basket outer surface 210. In other words, intermediate portion 216 is a tapered transition portion extending between rib upper and lower portions 212, 214. As such, ribs 202 are outwardly flared near a top 218 of basket 70 to minimize the impact, or obstruction, of ribs 202 while loading and unloading of clothes and laundry articles through open basket top 218. Further, rib intermediate portions 216 prevent snagging of clothes and laundry articles as clothes descend toward the bottom of basket 70.

In an illustrative embodiment, and as explained further below, inner surfaces of ribs 202 extend radially inwardly from outer wall surface 210 at a distance of about 0.395 inches to about 1.5 inches. It is appreciated, however, that other radial dimensions for ribs 202 may likewise be employed in alternative embodiments of the invention. Additionally, as seen in FIG. 5 rib lower portions 214 extend upwardly from a bottom 220 of basket 70 for a first vertical distance, rib intermediate portion 216 extends upwardly form rib lower portions 214 for a second vertical distance that is approximately equal to the first vertical distance, and rib upper portions 212 extend upwardly from rib intermediate portions 216 for a third vertical distance that is much less than the second vertical distance of the first vertical distance. Therefore, abrupt transitions between the rib segments or portions are avoided. It is understood, however, that other relative vertical dimensions and ratios of the rib segments may be employed in alternative embodiments of the invention.

In a further embodiment, and also as illustrated in FIG. 5, the faces of rib portions 212, 214, 216 vary in tangential or circumferential dimension also. The faces of rib upper portions 212 extend at a first tangential width, the faces of lower rib portions 214 extend at a second tangential width that is less than upper portions 212, and the faces of rib intermediate portions transition in tangential width between rib upper portions 212 and rib lower portions 214. In an exemplary embodiment, rib intermediate portions 216 are contoured into a conical shape somewhat resembling a tip of a writing utensil.

While it is believed that the described configuration (i.e., the radial and tangential dimensions of rib portions 212, 214, 216) of inwardly depending ribs 202 is advantageous from a material stress management perspective during use of basket 70, it is contemplated that other configurations of ribs 202, vertical and tangential or circumferential, may likewise produce similar results in alternative embodiments of the invention.

Figure 6:
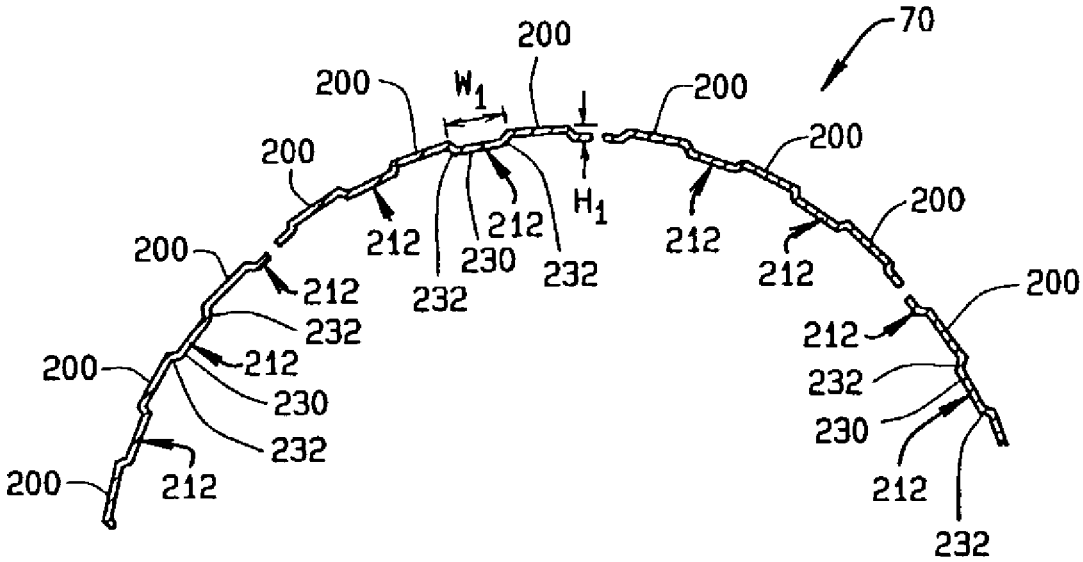
FIG. 6 is a partial horizontal cross sectional view of the basket along line 7-7 in FIG. 4.

FIG. 6 is a partial radial cross sectional view of basket 70 taken through a horizontal plane including rib upper portions 212. Rib upper portions 212 extend inwardly in a radial direction from basket outer peripheral wall 200 and each portion 212 includes a face 230 and sloped sides 232. Faces 230 extend circumferentially at a lesser diameter than, but generally parallel to, basket outer wall 200 such that faces 230 extend radially inwardly from peripheral wall 200 at a height $H_1$. Additionally, rib upper portion faces 230 extend for a tangential width $W_1$ and are substantially equally spaced from one another about the circumference of basket 70. In an exemplary embodiment, $W_1$ is sufficiently greater than $H_1$ to provide rib upper portions with a substantially rectangular appearance.

Figure 7:
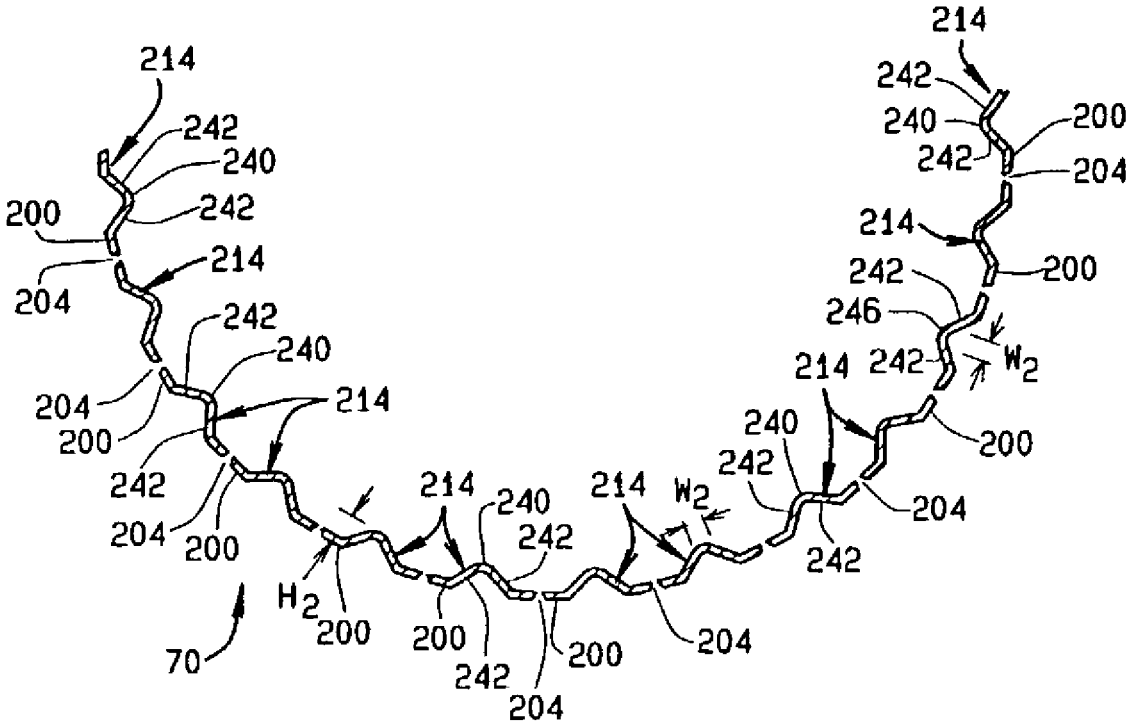
FIG. 7 is another partial horizontal cross sectional view of the basket along line 8-8 in FIG. 4.

FIG. 7 is a partial radial cross sectional view of basket 70 through a horizontal plane including rib lower portions 214 and illustrating rib lower portions 214 extending inwardly from basket outer peripheral wall 200. Each of rib lower portions 214 include a face 240 and sloped sides 242. Unlike rib faces 230 of rib upper portions 212 (shown in FIG. 6), faces 240 are curved and inwardly pointed to project noticeably within the basket interior. Faces 240 extend radially inwardly at a height $H_2$ from outer peripheral wall 200 that is greater than height $H_1$ of rib upper portions 212 (shown in FIG. 6). Additionally, faces 240 of rib lower portions 214 extend for a tangential width $W_2$ and are substantially equally spaced from one another about the circumference of basket 70. As illustrated in FIG. 7, rib faces 240 and sides 242 provide rib lower portions 214 with a generally triangular appearance.

Rib intermediate portions 216 (shown in FIG. 5) in cross section transition between the cross sections of rib upper portions 212 (shown in FIG. 6) and rib lower portions 214. Thus, $H_1$ transitions to $H_2$ and $W_1$ transitions to $W_2$ through intermediate portions 216 extending between upper and lower rib portions 214, 216. As is evident from FIG. 5, the rib face height and width is variable (i.e., not constant or uniform) in rib intermediate portions 216 between upper and lower rib portions 212, 214.

Apertures 204 extend through outer peripheral wall 200 and are approximately centered between adjacent ribs and evenly spaced about the circumference of basket 70. In an exemplary embodiment, apertures 204 are located approximately 15° from one another with respect to a center of the wheel and 24 apertures 204 are thus located in the plane of FIG. 7. Comparing FIGS. 5 and 7, it may then be seen that in an exemplary embodiment basket 70 includes 216 (24 apertures per plane times 9 planes of apertures shown in FIG. 5) water extraction apertures. It is contemplated that in alternative embodiments greater or fewer than 216 apertures may be employed.

Figure 8:
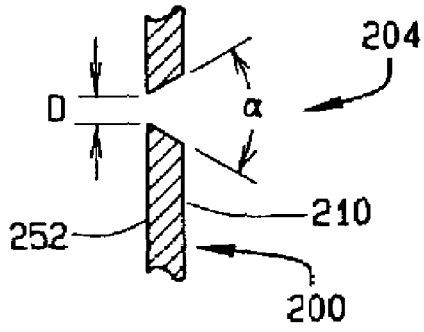
FIG. 8 is a detail view of a portion of FIG. 7.

FIG. 8 is a detail view of one of apertures 204 extending through basket outer peripheral wall 200. Aperture is outwardly flared (i.e., increased in diameter) from an inner surface 252 of wall 200 toward wall outer surface 210. In an exemplary embodiment, aperture 204 has an initial diameter D at wall inner surface 252 of about 0.125 inches and flares outwardly at an angle $\alpha$ of about 63.5° through the thickness of wall 200. While these dimensions have been found particularly advantageous in at least one washing machine, it is recognized that the dimensions of apertures 204 may be varied in alternative embodiments without departing from the scope of the present invention.

Figure 9:
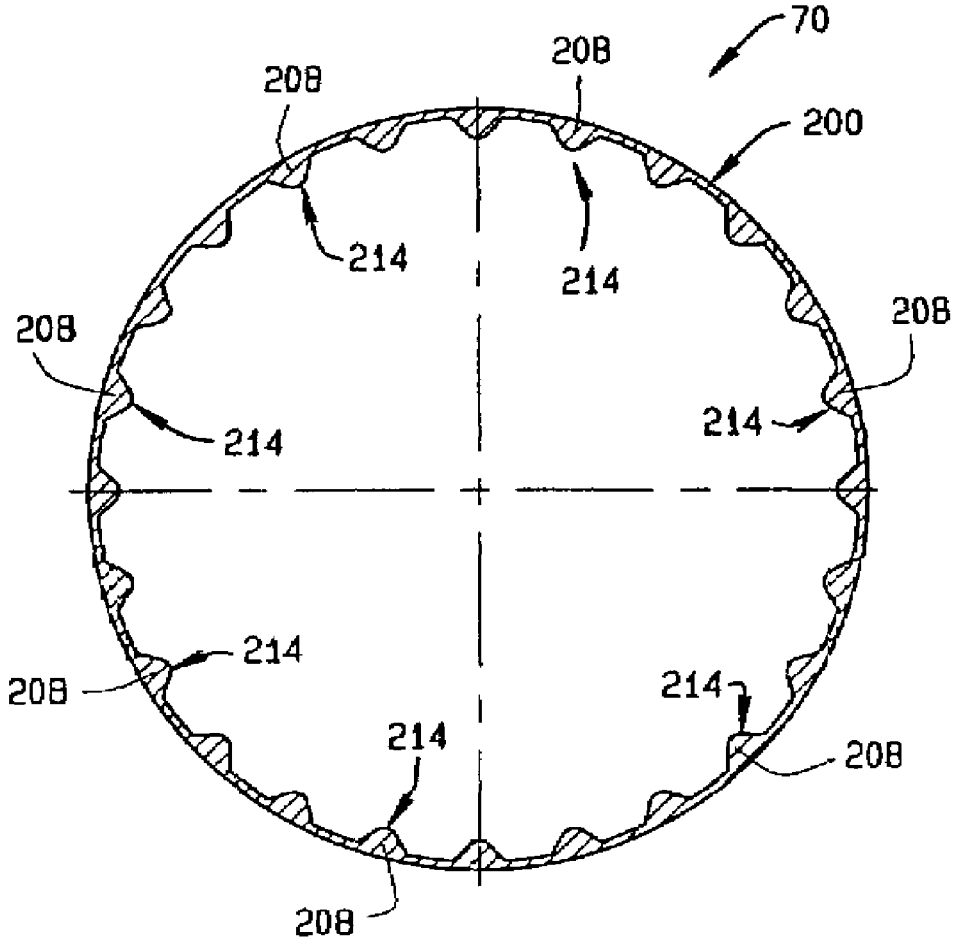
FIG. 9 is another horizontal cross sectional view of the basket along line 9-9 in FIG. 4.

FIG. 9 is a full radial cross sectional view of basket 70 through a horizontal plane including rib supports 208 in rib lower portions 214. Rib lower portions 214 extend inwardly from basket outer peripheral wall 200, and supports 208 fully connect ribs 214 to wall 200. Comparing FIGS. 5, 7 and 9, it may be seen that rib portions 214 are hollow (as illustrated in FIG. 7) between supports 208 and solid within supports 208 (as illustrated in FIG. 9). The alternately hollow and solid rib structure within rib lower and intermediate portions 214, 216 provides adequate stiffness and rigidity to withstand the washing machine environment and associated loads without using excessive materials to fabricate basket 70.

In an illustrative embodiment, basket 70 is fabricated from a known plastic material according to known techniques, such as an injection molding process. It is appreciated that basket 70 may be fabricated from other known materials and by other techniques familiar to those in the art.

Figure 10:
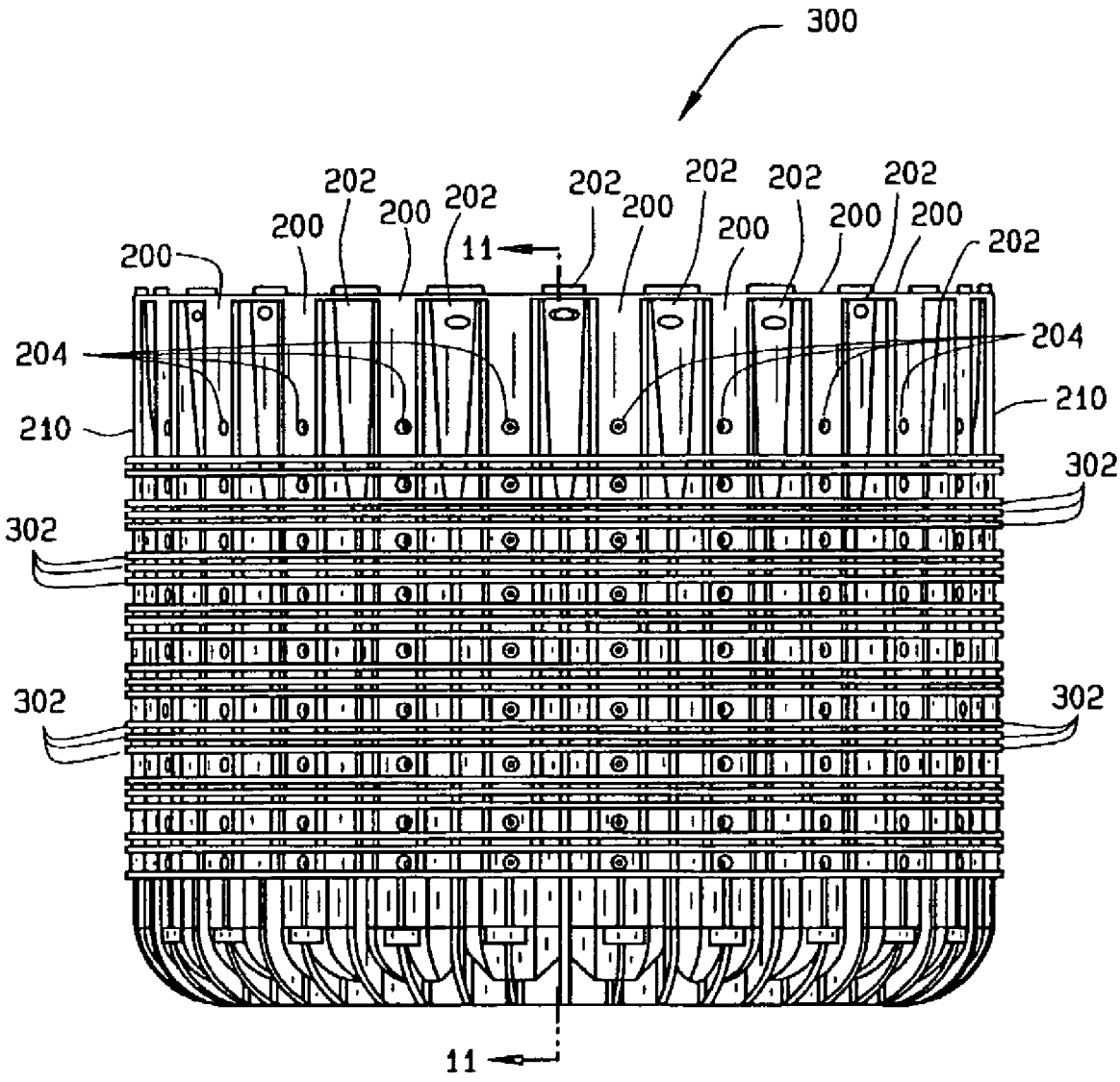
FIG. 10 is an elevational view of a second embodiment of a basket for the machine shown in FIGS. 1 and 2.

FIG. 10 is an elevational view of a second embodiment of a basket 300 for use in for example, washing machine 50 (shown in FIGS. 1 and 2). Basket 300 is similar to basket 70 (shown in FIGS. 5-10) in most aspects, and except as noted below, basket 300 is constructed substantially as basket 70 described above. Consequently, like reference characters are used to indicate like features of basket 300 and basket 70.

Basket 300 includes outer peripheral wall 200 that is generally cylindrical in shape, has a substantially constant draft in diameter (e.g., about a 1.5° draft in one embodiment), and extends circumferentially about an outer periphery of basket 70. Apertures 204 extend through wall 200 for passage of water and wash fluid, and ribs 202 depend inwardly from outer peripheral wall 200 toward a center, or toward the interior, of basket 300.

Unlike, basket 70 which contains support ribs 208 (shown in FIGS. 5 and 8) substantially flush with an outer surface 210, basket 300 includes support bands or rims 302 extending above and beyond basket wall outer surface 210 (i.e., not flush) and extending completely around the outer circumference of basket 300. Addition of support bands 302 has been found to substantially lower stress encountered in basket 300 during use in comparison to basket 70.

Figure 11:
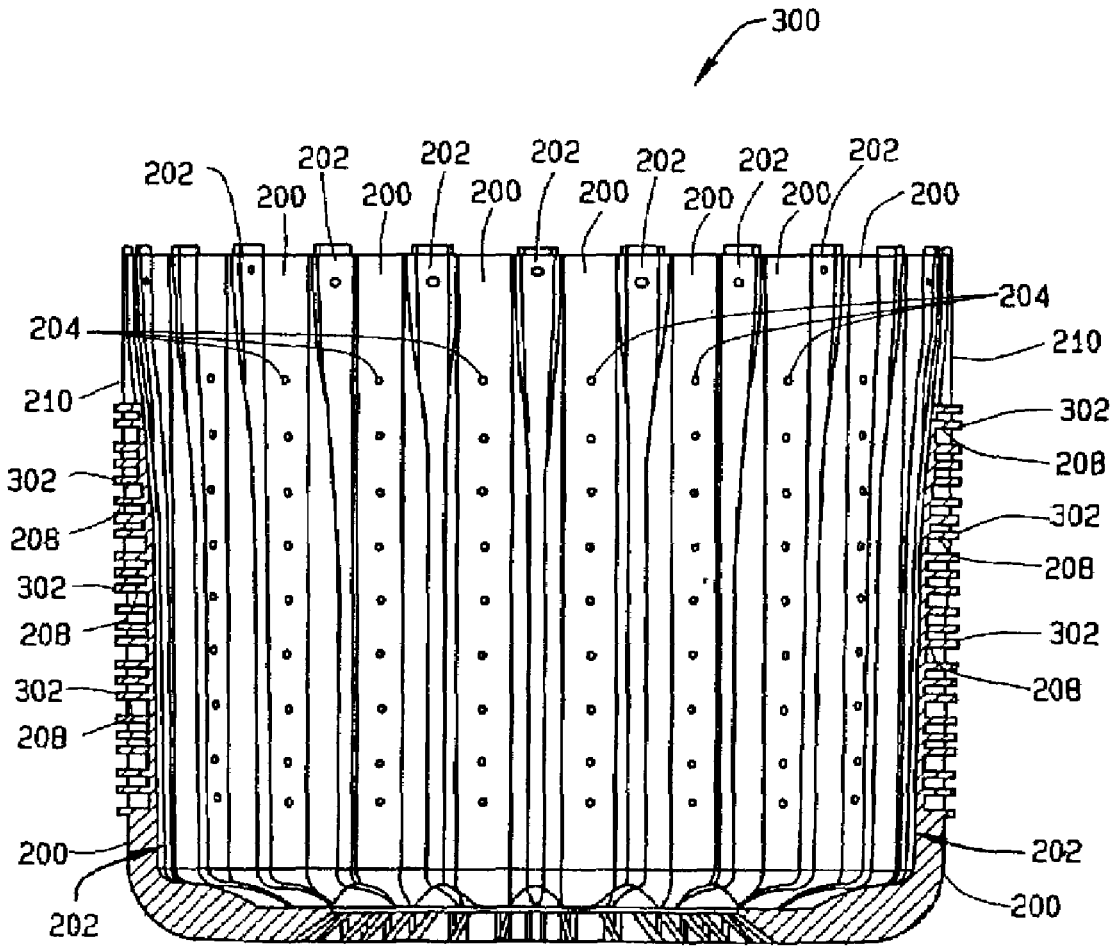
FIG. 11 is a vertical cross sectional view of the basket shown in FIG. 10.

FIG. 11 illustrates basket 300 in vertical cross section. Ribs 202 project inwardly from basket outer peripheral wall 200 such that the face of each rib 202 is spaced radially inwardly from an outer surface 210 of basket outer peripheral wall 200. Apertures 204 extend through outer peripheral wall 200 and are generally vertically aligned in columns between ribs 202. Supports 208 extend radially outwardly from behind the faces and between the sides of ribs 202, and support bands 302 extend from supports 208 beyond outer face 210 of basket wall 200 to reinforce basket 300 behind ribs 202 and also behind basket outer wall 200 between ribs 202.

In an exemplary embodiment, basket is formed integrally so that basket wall 200, ribs 202, supports 208, and support bands 300 are of a unitary construction. The combination of support features in basket 300 reduces stress levels in basket 300 in use, thereby allowing basket 300 to withstand heavier laundry loads and higher rates of basket spin than, for example, basket 70.

While the invention has been described in terms of various specific embodiments, those skilled in the art will recognize that the invention can be practiced with modification within the spirit and scope of the claims.

The invention claimed is:

1. A basket for a washing machine, said basket comprising:

a body comprising an outer peripheral wall and at least one rib extending radially inward from said outer peripheral wall, said rib comprising at least a first portion having a first cross section and a second portion having a second cross section, said second cross section different from said first cross section, said outer peripheral wall including a plurality of apertures therethrough, said apertures arranged in single vertically aligned columns between adjacent ribs;

wherein said rib comprises a face and substantially planar opposing sides extending from said face, said basket further comprising a plurality of supports, each of said plurality of supports extending radially outward from said face toward said outer peripheral wall, and extending between said opposing sides of said rib such that each said support is substantially flush with said outer peripheral wall, said plurality of supports spaced apart in a direction substantially parallel to a rotational axis of said basket such that portions of said rib are hollow between adjacent supports and solid at said supports from said face and said opposing sides to said outer peripheral wall.

2. A basket in accordance with claim 1 wherein said rib extends substantially vertically.

3. A basket in accordance with claim 1 wherein said first portion is substantially rectangular in cross section.

4. A basket in accordance with claim 1 wherein said rib extends radially inward from said outer wall for a distance of about 0.395 to about 1.5 inches.

5. A washing machine basket comprising:

an outer peripheral wall having an outer surface;

a plurality of ribs projecting radially inwardly from said outer peripheral wall, each said rib comprising a face and substantially planar opposing sides extending from said face, and a first end and a second end, said first end projecting a first radial distance from said outer peripheral wall, said second end projecting a second radial distance from said outer peripheral wall, said first radial distance less than said second radial distance;

a plurality of apertures formed in said outer peripheral wall, said apertures arranged in single vertically aligned columns between adjacent ribs; and a plurality of supports each extending radially outwardly from said face toward said outer peripheral wall, and extending between said opposing sides of said rib such that each said support is substantially flush with said outer surface, said plurality of supports spaced apart in a direction substantially parallel to a rotational axis of said basket such that portions of said rib are hollow between adjacent supports and solid at said supports from said face and said opposing sides to said outer peripheral wall.

6. A basket in accordance with claim 5, said rib comprising a transition portion projecting a variable distance from said outer wall, said variable distance ranging from said first radial distance to said second radial distance.

7. A basket in accordance with claim 6 wherein said variable distance is about 0.395 inches to about 1.5 inches.

8. A basket in accordance with claim 6, said transition portion further having a varying width.

9. A washing machine basket comprising:

an outer peripheral wall and a plurality of vertically extending ribs projecting radially inwardly from said outer peripheral wall at a distance of about 0.395 to about 1.5 inches, said outer peripheral wall including a plurality of apertures therethrough, said apertures arranged in single vertically aligned columns between adjacent ribs; and wherein each said rib comprises a face and substantially planar opposing sides extending from said face, said basket further comprising a plurality of supports, each of said plurality of supports extending radially outward from said face toward said outer peripheral wall, and extending between said opposing sides of said rib such that each said support is substantially flush with said outer peripheral wall, said plurality of supports spaced apart in a direction substantially parallel to a rotational axis of said basket such that portions of said rib are hollow between adjacent supports and solid at said supports from said face and said opposing sides to said outer peripheral wall.

10. A basket in accordance with claim 9, wherein said apertures are outwardly flared.

11. A basket in accordance with claim 9 wherein said ribs are outwardly flared at one end thereof.

12. A basket in accordance with claim 9 further comprising at least one circumferential support band extending from at least one of said plurality of supports, said at least one circumferential support band extending around an outer surface of said outer wall.

13. A basket in accordance with claim 9 wherein a portion of said rib is substantially triangular.

14. A washing machine basket comprising:

a substantially cylindrical outer peripheral wall and a plurality of inwardly projecting ribs depending therefrom, each said rib comprising:

a first portion having a first radially extending height from said outer peripheral wall and a first tangential width; and a second portion having a second radially extending height from said outer peripheral wall and a second tangential width, said first height less than said second height, said first width greater than said second width;

wherein, said outer peripheral wall includes a plurality of apertures therethrough, said apertures arranged in single vertically aligned columns between adjacent ribs; and wherein said rib comprises a face and substantially planar opposing sides extending from said face, said basket further comprising a plurality of supports, each of said plurality of supports extending radially outward from said face toward said outer peripheral wall, and extending between said opposing sides of said rib such that each said support is substantially flush with said outer peripheral wall, said plurality of supports spaced apart in a direction substantially parallel to a rotational axis of said basket such that portions of said rib are hollow between adjacent supports and solid at said supports from said face and said opposing sides to said outer peripheral wall.

15. A basket in accordance with claim 14 wherein said first height and said second height are in a range from about 0.395 to about 1.5 inches.

16. A basket in accordance with claim 14 wherein said first portion is substantially rectangular and said second portion is substantially triangular.

17. A washing machine comprising:

a cabinet; and a basket rotatably mounted in said cabinet, said basket comprising an outer peripheral wall and a plurality of radially inwardly projecting ribs extending from said outer peripheral wall, said ribs having a varying width between ends thereof, said basket further including a plurality of apertures therethrough, said apertures arranged in single vertically aligned columns between adjacent ribs; and wherein each said rib comprises a face and substantially planar opposing sides extending from said face, said basket further comprising a plurality of supports, each of said plurality of supports extending radially outward from said face toward said outer peripheral wall, and extending between said opposing sides of said rib such that each said support is substantially flush with said outer peripheral wall, said plurality of supports spaced apart in a direction substantially parallel to a rotational axis of said basket such that portions of said rib are hollow between adjacent supports and solid at said supports from said face and said opposing sides to said outer peripheral wall.

18. A washing machine in accordance with claim 17, said ribs extending inwardly from said outer wall at a height of approximately 0.395 to 1.5 inches.

* * * * *